US007089176B2

(12) United States Patent
Boillot et al.

(10) Patent No.: US 7,089,176 B2
(45) Date of Patent: Aug. 8, 2006

(54) METHOD AND SYSTEM FOR INCREASING AUDIO PERCEPTUAL TONE ALERTS

(75) Inventors: Marc Andre Boillot, Plantation, FL (US); Dennis Anson, Coral Springs, FL (US); Audley F. Patterson, Miramar, FL (US)

(73) Assignee: Motorola, Inc., Schaumburg, IL (US)

( * ) Notice: Subject to any disclaimer, the term of this patent is extended or adjusted under 35 U.S.C. 154(b) by 82 days.

(21) Appl. No.: 10/400,845

(22) Filed: Mar. 27, 2003

(65) Prior Publication Data

US 2005/0278165 A1 Dec. 15, 2005

(51) Int. Cl.
*G10L 21/00* (2006.01)

(52) U.S. Cl. ..... 704/200.1

(58) Field of Classification Search ..... 704/224, 704/225, 200.1; 381/316–320
See application file for complete search history.

(56) References Cited

U.S. PATENT DOCUMENTS 5,029,217 A * 7/1991 Chabries et al. ..... 381/317
5,812,969 A * 9/1998 Barber et al. ..... 704/224
6,104,822 A * 8/2000 Melanson et al. ..... 381/320
2003/0165247 A1 * 9/2003 Bantz et al. ..... 381/316

OTHER PUBLICATIONS

Beranek, Acoustics, 1954, McGraw-Hill Book Company, Inc., pp. 398-403.*

* cited by examiner

*Primary Examiner*—David D. Knepper

(57) ABSTRACT

A method, system and computer readable medium for increasing the audio perceptual loudness includes shifting at least one frequency of a first audio signal to create a second audio signal so as to increase the audio perceptual loudness. The power level of the second audio signal is not more than a power level of the first audio signal. The method also includes generating high-audio perceptual loudness tone alert sequences based on psychoacoustic and audiometric data. It further includes acquiring a listener's threshold audio profile; adding the listener's audio profile to the loudness sensitivity curve for producing the listener's tonal sensitivity curve; determining a required dB scaling for critical band tones from the listener's tonal sensitivity curve; normalizing the tonal sensitivity curve for creating a decibel curve; selecting a frequency range of the tones by using the tonal sensitivity curve; and spacing the sequence of tones along a critical band scale.

11 Claims, 10 Drawing Sheets

METHOD AND SYSTEM FOR INCREASING AUDIO PERCEPTUAL TONE ALERTS

FIELD OF THE INVENTION

The present invention generally relates to the field of generating alert signals and alerting devices, and more particularly relates to increasing the audio perceptual loudness and generating alert signals based on psychoacoustic/audiometric data.

BACKGROUND OF THE INVENTION

There is a large world market for hand-held wireless communication devices, and it is always of concern to design these systems to operate with the lowest amount of power. Advances in miniaturization of hand held devices such as cell phones, pagers and PDAs are often limited by power source constraints, including battery sizes. Many cell phones and small consumer audio appliances with limited power configuration are equipped with transducers such as speakerphones that project the speech to the listener instead of being directly coupled to the ear. Much of the current focus in industry technology has been on better speaker design or more efficient resourcing of current drain in the power amplification stage. No energy conservation schemes directly operate on the audio alerts to generate alerts. Alerts are typically used to notify users of incoming calls, pages, text messages, calendar alarms and more.

Recent demands in today's market for increased quality in the production of audio alerts have led to deploying digital techniques. With reference to medical alerting devices, the conventional embedded low-power medical device alerts must be sufficiently loud so as to draw the attention of the device-holder. Conventional on-the-body medical alert devices are used intermittently, since the device-holder may be performing other activities and needs to be notified only when a medical-alert is necessary. In most cases, the holder is not paying attention to the device.

In addition, conventional medical device alerts (such as those used on pagers) use a single tone to alarm the individual: for example, a runner's heart rate monitor or a wristwatch to measure speed. Typically, the tone is about 1 KHz, since informal listening tests reveal that the frequency is annoying enough to draw the attention of the user and solicit a response. However, the tone is not optimal for loudness while maintaining a low power requirement.

Further, studies have shown that the psychoacoustic and audiometric data varies from listener to listener. Stated differently, a system optimized for loudness for a given listener often is not optimized for another listener. Accordingly, a need exists to supply a system which can be customized to a particular user.

SUMMARY OF THE INVENTION

The present invention increases the audio perceptual loudness and generates the optimal tone sequence for achieving maximal loudness based on the device-speaker response, the listener's auditory profile, and the knowledge of sound in human hearing. The present invention utilizes psycho-acoustic knowledge of loudness to generate a tone sequence, which corresponds to maximal loudness according to the listener's auditory profile, while maintaining a low power requirement.

According to one embodiment of the present invention, a method, a computer readable medium, and a system for increasing the audio perceptual loudness includes shifting at least one frequency of a first audio signal to create a second audio signal so as to increase the audio perceptual loudness, while maintaining a low power requirement. The method includes generating an audio speaker frequency response curve for a given volume setting and speaker; selecting an equal loudness reference curve; creating a loudness sensitivity curve for a given audio speaker response by subtracting the loudness reference curve from the audio speaker frequency response curve; acquiring a listener's threshold audio profile; adding the listener's audio profile to the loudness sensitivity curve for producing the listener's tonal sensitivity curve if an abnormal-hearing listener; determining a required dB scaling for critical band tones from the listener's tonal sensitivity curve; normalizing the tonal sensitivity curve for creating a decibel curve; selecting a frequency range of the tones by using the tonal sensitivity curve; and spacing the sequence of tones along a critical band scale.

DETAILED DESCRIPTION

Figure 1:
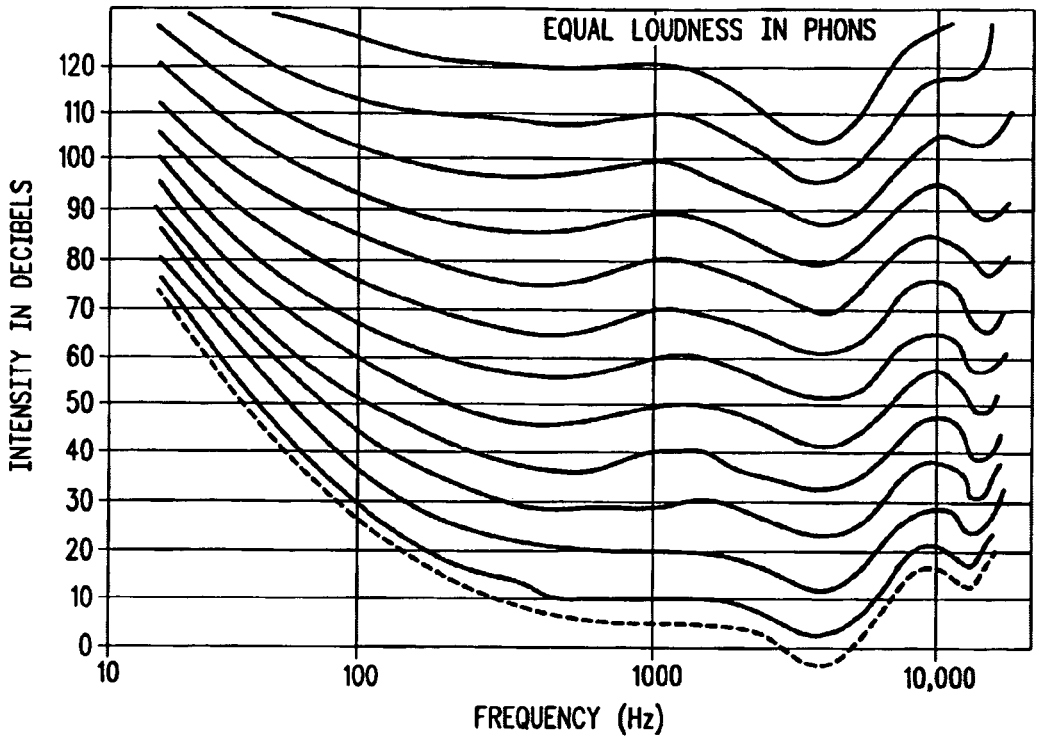
FIG. 1 is a graph illustrating loudness curves adapted from the ISO-226.

As stated above, the present invention incorporates psychoacoustic knowledge with the listener's auditory hearing profile in the tone alert sequence to achieve the loudest alert available while maintaining the power required.

The present invention works with many currently available systems through a software or firmware update. In one embodiment, the present invention allows an user to optimize the tone alert for the user's audiometric profile.

The critical band concept of hearing is that when the energy remains constant in a critical band, loudness will increase (when a critical bandwidth is exceeded). Simply put, multiple tones on a frequency scale will be loudest when the tones are all separated in frequency by a certain bandwidth (called "critical bandwidth") as compared to being grouped together. In addition, the dB gain of each tone is selected as a function of the listener's auditory profile. The ISO-226 equal loudness contours provide the loudness levels at which tones sound equally loud across the frequency spectrum. The equal loudness tones concept states that tones between 1 KHz to 4 KHz are perceived louder than any other tones.

In addition, auditory profiles of hearing-impaired individuals with moderate hearing loss generally show high frequency loss of about −10 dB at 2 KHz. This allows the narrowing of the range of tones necessary for optimal loudness. Upon applying the critical band concept to a tone sequence in the range 1 KHz to 2 KHz, one can see that 7 tones are necessary for critical band spacing to achieve optimal loudness: namely, 1000, 1170, 1370, 1600, 1850, 1720, and 2000 Hz. The auditory profile of the listener is included to optimize the loudness of the alert sequence.

Loudness in Human Perception

Loudness is the human perception of intensity and is a function of the sound intensity, frequency, and quality [for further information see William Hartmann. *Signals, Sound, and Sensation*. Springer, New York, 1998.]. The sound energy level can be represented as a function of intensity, I, and as a function of acoustic pressure, p, since I α p2, as shown below.

$$L = 10\log_{10}\frac{I_1}{I_2} = 20\log_{10}\frac{p_1}{p_2} \quad (1)$$

When the denominator values are chosen as reference variables corresponding to the threshold of hearing, the decibel pressure ratio becomes the sound pressure level SPL and the decibel intensity ratio becomes the intensity level. Human sensations (such as hearing) increase logarithmically as the intensity of the stimulus increases [for further information see S. Stevens. The direct estimation of sensory magnitudes: loudness. *American Journal of Psychology*. 69:1–25, 1956.]. To measure loudness it is necessary to establish a reference that relates the subjective sensation to the physical meaning. The loudness level was created to characterize the loudness sensation of any sound, since magnitude estimations do not provide an accurate representation. The loudness level of a sound is the sound pressure level of a 1-KHz tone that is as loud as the sound under test. The unit measure is the "phon" and it is an objective value to relate the perception of loudness to the SPL. Any sounds with equal phon levels are at equal loudness levels. The continuous frequency spectrum can be assigned phon levels for a given SPL. The contours of these curves are known as the equal loudness curves [for further information see ISO-226. Acoustics—normal equal loudness contours. *ISO Geneva, Switzerland,* 1987.].

FIG. 1 illustrates equal loudness curves adapted from the ISO 226. The set of the curves for the SPL values from the threshold of hearing to the ceiling of hearing defines a measure of equivalent loudness in phon at each frequency. The dotted line in FIG. 1 represents the threshold of hearing where the limit of loudness sensation is reached. This occurs at the 3 phon level, since the threshold in quiet corresponds to 3 dB at 1 KHz [for further information see E. Zwicker and H. Fastl. *Psychoacoustics*. Springer Series, Berlin, 1998.].

However, the phon does not provide a measure for the scale of loudness. A loudness scale provides a unit of measure stating how much louder one sound is perceived in comparison to another. The phon level states the SPL level required to achieve the same loudness level. It does not establish a metric, or unit of loudness. The "sone" was introduced to define a subjective measure of loudness where a sone value of 1 corresponds to the loudness of a 1 KHz tone at an intensity of 40 dB SPL for reference [for further information see S. Stevens. The direct estimation of sensory magnitudes: loudness. *American Journal of Psychology,* 69:1–25, 1956.]. The sone scale defines a scale of loudness such that a quadrupling of the sone level quadruples the perceived loudness. An empirical relation between the sound pressure p and the loudness S in sones is typically given by $S \propto I^k$ where $k \approx 0.3$. A ten-fold increase in intensity corresponds to a 10 phon increase in SPL. Since loudness is approximately proportional to the cube root of the intensity, a 10 phon increase roughly corresponds to a doubling of the sone value. The sound is perceived twice as loud.

Critical Bands

The most dominant concept of auditory theory is the critical band concept [for further information see H. Fletcher and W. J. Munson. Loudness, its definition, measurement, and calculation. *J. Acoust. Soc. Am,* 5:82–108, 1933.]. The critical band concept defines the processing channels of the auditory system on an absolute scale with the representation of hearing. The critical band represents a constant physical distance along the basilar membrane [for further information, see E. Zwicker and H. Fastl. *Psychoacoustics*. Springer Series, Berlin. 1998.]. It represents the signal processes within a single auditory nerve cell or fiber. Spectral components falling together in a critical band are processed together [for further information see E. Zwicker. Procedure for calculating loudness of temporally variable sounds. *J Acoust. Soc. Am,* 62 (3):675–682, 1977.]. The critical bands are considered independent processing channels. Collectively they constitute the auditory representation of the sound. The critical band has also been regarded as the bandwidth in which sudden perceptual changes are noticed [for further information see William Hartmann. *Signals, Sound and Sensation*. Springer, New York, 1998.].

The following approximation relates critical band rate and bandwidth to frequency in kHz [for further information see E. Zwicker and E. Terhardt. Analytic expressions for critical band rate and critical bandwidth as a function of frequency. *J. Acoust. Soc. Am,* 68:1523–1525, 1980.].

$$\frac{z}{Bark} = 13\tan^{-1}(0.76f) + 3.5\tan^{-1}(f)^2 \quad (2)$$

However, this formula is not invertible in closed form, and an invertible procedure is given in Eq. (3) as follows [for further information see H. Traunmuller. Analytic expressions for the tonotopic sensory scale. *J. Acoust. Soc. AM,* 88:97–100, 1990.].

$$z' = 26.81f/(1960+f) - 0.53 \quad (3)$$

$$z = \begin{cases} z' + 0.15(2.0 - z') & z' < 2.0 \\ z' & 2.0 < z' < 20.1 \\ z' + 0.22(z' + 20.1) & z' > 20.1 \end{cases}$$

Figure 2:
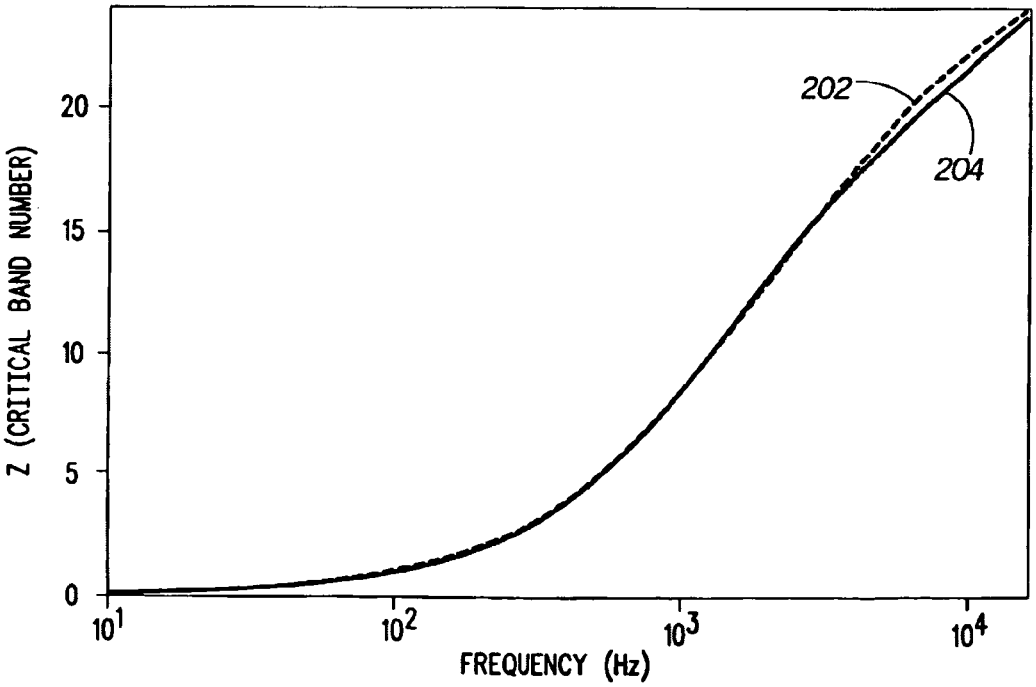
FIG. 2 is a graph illustrating a mapping of a linear frequency scale to a critical band scale given by equations (2) and (3).

FIG. 2 is a graph illustrating a mapping of a linear frequency scale to a critical band scale given by equations (2) and (3). Accordingly, FIG. 2 shows the critical band scale established by both of the equations (2) and (3). Fletcher's original experiments on masking phenomena revealed the characteristics of the critical band concept. In these experiments, the audibility of a pure tone is evaluated for different noise bandwidths. The experimental results demonstrate that audibility is affected only by the amount of noise in the critical band. As bandwidth decreases below a critical bandwidth, the detection threshold of the tone decreases. The experiments suggested the existence of an auditory filter. Since noise outside a certain bandwidth does not affect detection thresholds, an auditory mechanism (which suppresses these components) seemed likely. The auditory filter can be considered a physiological process, which suppresses components outside the filter region but does not adversely affect signals within the filter. The purpose of the auditory filter is to isolate signal components of interest and to attenuate the signal contributions outside this region. The region defined by this boundary is the critical bandwidth, and the experimental results show that this critical bandwidth increases with increasing frequency [for further information see E. Zwicker and H. Fastl. *Psychoacoustics*. Springer Series, Berlin, 1998.].

The critical band concept is crucial for describing hearing sensations, especially loudness. If the intensity of a sound is fixed, the loudness of sound remains constant as long as the bandwidth is less than a critical band [for further information see E. Zwicker and H. Fastl. *Psychoacoustics*. Springer Series, Berlin, 1998.]. Once the bandwidth increases beyond a critical band, loudness will increase. When the bandwidth exceeds the critical bandwidth the loudness increases, although the energy remains constant. This is based on the fact that human hearing system analyzes a broad spectrum into parts that correspond to critical bands. It is also consistent with the auditory filter concept in which frequency is continuously encoded along the basilar membrane and in which loudness is linearly related to the area of excitation [for further information see A. T. Cacace and R. H. Margolis. On the loudness of complex stimuli and its relationship to cochlear excitation. *J Acoust. Soc. Am,* 78 (5):1568–1573, 1985.]. The critical band rate provides a measure of loudness over a continuum of frequency channels. Since these auditory channels are process independent, their sum provides an overall evaluation of perceived loudness.

By assigning each critical band as a discrete unit of loudness, it is possible to assess the loudness of a spectrum by summing the individual critical band units [for further information see E. Zwicker. Procedure for calculating loudness of temporally variable sounds. *J. Acoust. Soc. Am,* 62 (3):675–682, 1977.]. The sum value represents the perceived loudness generated by the sound spectrum. The loudness value of each critical band unit is a specific loudness, and the critical band units are referred to as Bark units. Thus, 1 Bark interval corresponds to a given critical band integration [for further information see E. Zwicker and H. Fastl. *Psychoacoustics*. Springer Series, Berlin, 1998.]. The critical band scale is a frequency to place transformation of the basilar membrane.

Auditory Filters

Subjective listening tests and experiments reveal a description of the auditory filter shapes [for further information see R. Patterson. Auditory filter shapes derived with noise. *J. Acoust. Soc. Am,* 74:640–654, 1976 and E. Zwicker and H. Fastl. *Psychoacoustics*. Springer Series, Berlin, 1998 and B. C. Moore and B. R. Glasberg. Auditory filter shapes derived in simultaneous and forward masking. *J. Acoust. Soc. America,* 70:1003–1014, 1981.]. The first estimates were from the results of tone and noise masking experiments [for further information see H. Fletcher and W. J. Munson. Loudness, its definition, measurement, and calculation. *J Acoust. Soc. Am,* 5:82–108, 1933.]. Fletcher revealed the concept of the critical band and approximated the auditory filter that defined the boundary of a critical band as a rectangular filter. The width of an auditory filter is generally described in terms of critical bands for simplicity. However, they are not really rectangular in shape.

The concept of an Equivalent Rectangular Bandwidth (ERB) is useful to describe the critical bandwidths [for further information see William Hartmann. *Signals, Sound, and Sensation*. Springer, New York, 1998.]. The ERB is a rectangular filter with unit height and bandwidth that contains the same amount of power as the critical band. Eq. (4) provides an approximate expression of the ERB for Eq (2) as follows [for further information see William Hartmann. *Signals, Sound, and Sensation*. Springer, New York, 1998.]:

$$\frac{\Delta f_G}{Hz} = 25 + 75[1 + 1.4(f_{KHz})^2]^{0.69} \quad (4)$$

The critical bandwidth is linear up to about 500 Hz and then increases logarithmically and in proportion to center frequency. A refined experimental procedure for determining auditory filter shapes is the noise notch method proposed by Patterson [for further information see R. Patterson. Auditory filter shapes derived from noise. *J Acoust. Soc. Am,* 74:640–654, 1976.]. It favorably constrains the masking effects to provide a better observation of the auditory filtering process. This method restricts the auditory filter during testing to within a certain bandwidth as given by the noise notch. It provides a way to trace out the critical band filter shape. Patterson and Nimmo [for further information see R. Patterson, J. Nimmo-Smith, and P. Rice. The auditory filterbank. *MRC-APU report* 2341, 1991.] suggested the rounded exponential (roex) function in Eq (5) to parameter ize the auditory filter shape which described their experimental results, as shown below.

$$|H(f)|^2=(1+pg)e^{-pg} \quad (5)$$

where g is the normalized deviation of the evaluation frequency to the center frequency, fc;

$$g=|(f-fc)/fc| \quad (6)$$

and p is a dimensionless parameter which describes the bandwidth and filter slopes. Moore and Glasberg proposed the parameters $p_1$ and $p_u$ to model an asymmetrical filter shape at different input levels as a better fit to the experimental data [for further information see B. C. Moore and B. R. Glasberg. Formulae describing frequency selectivity as a function of frequency and level and their use in calculating excitation patterns. *Hearing Research,* 28:209–225, 1987.]. The auditory filters are approximately symmetrical on a linear scale when the input level of the auditory filters is L=51 dB/ERB.

$$p(f_c)=4f_c/(24.7+0.108f_c) \quad (7)$$

$$p_u(f_c)=p(f_c)$$

$$p_l(f_c) = p(f_c)(1 - \frac{0.38}{p(1\ \text{KHz}}(L - 51_{\text{dB}})$$

These modifications have been used to generate nonlinear models of the peripheral auditory system [for further information see Martin Pflueger, Robert Hoeldrich, and William Reidler. A nonlinear model of the peripheral auditory system. *IEM Report*, pages 1–10, February 1998.], and for different representations of the ERB bandwidth leading to Lyon's and Greenwood's model (cited in Slaney [for further information see Malcolm Slaney. An efficient implementation of the Patterson-Holdsworth auditory filter bank. *Apple Computer Technical Report* 35, 1993.]). Moore and Glasberg concluded that the critical variable determining auditory filter shape was the input level to the filter. They also provided "corrections" to the outer to middle ear transfer function as a better fit to experimental results.

Figure 3:
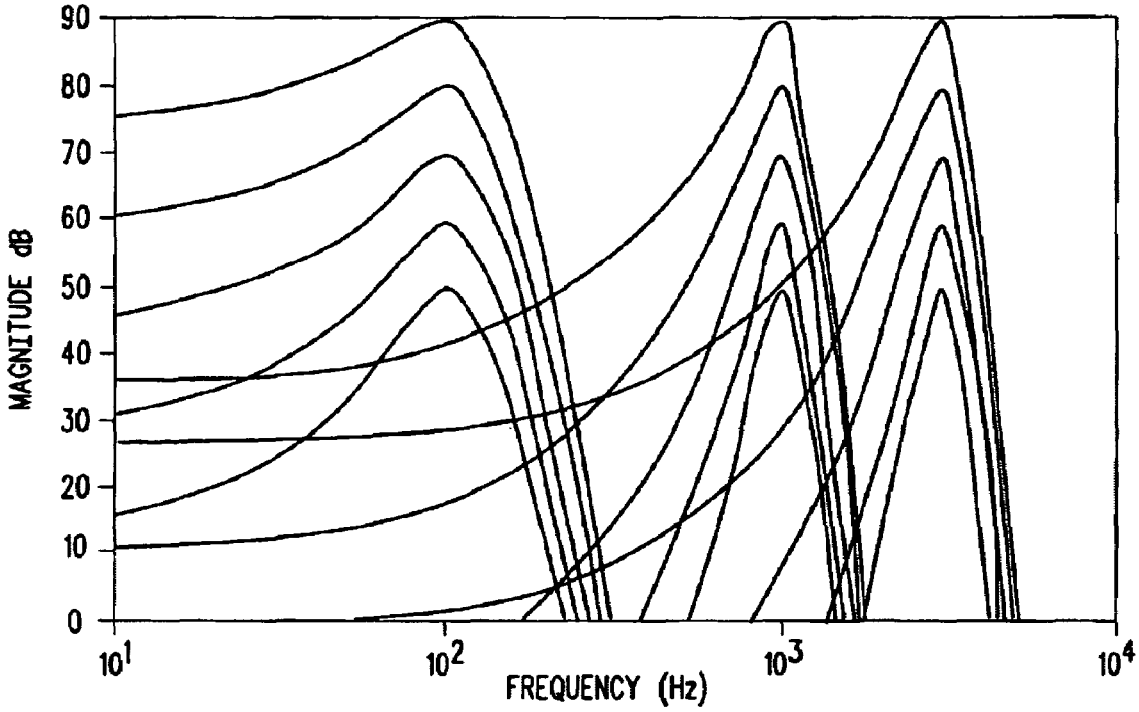
FIG. 3 is a graph illustrating simulated level-dependent roex auditory filter responses for input levels 50 to 90 dB at center frequencies of fc=100 Hz, 1 KHz, and 3 KHz.

FIG. 3 illustrates the simulated level-dependent roex auditory filter responses for input levels 50 to 90 dB at center frequencies of fc=100 Hz, 1 KHz, and 3 KHz. The low frequency auditory filter slope decreases with level, and the high frequency slope slightly increases with level.

Excitation

Loudness is a function of the excitation pattern, where the excitation is the residual response of the auditory filters. The excitation pattern of a sound is a representation of the activity or excitation evoked by that sound as a function of characteristic frequency [for further information see E. Zwicker and H. Fastl. *Psychoacoustics*. Springer Series, Berlin, 1998.]. The excitation pattern is used in all models of loudness. There are two general approaches to determining excitation patterns.

Figure 4:
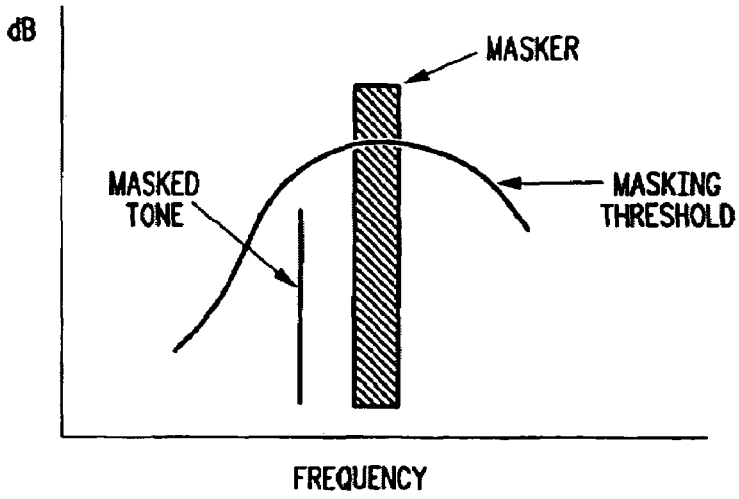
FIG. 4 is a graph illustrating narrowband pure tone masking threshold.

FIG. 4 illustrates narrowband pure tone masking threshold. Accordingly, FIG. 4 shows the first method (used in ISO-532B [for further information see ISO-532. Acoustics—method for calculating loudness level. *ISO Geneva, Switzerland,* 1975.]), which calculates the spread of excitation across critical bands from the masking of pure tones by narrowband noise. A narrowband noise at a given frequency is the masker and the tone to detect is varied in frequency. The resulting threshold curve is the masking pattern. The masking effect refers to the phenomenon that certain sounds become inaudible in the vicinity of louder neighboring sounds. A partial masking effect reduces the audibility but does not completely mask the sound. The masking patterns describe a masked threshold in relation to the test tone's frequency. Zwicker and colleagues suggested that the resulting masking patterns represented the evoked neural excitation [for further information see E. Zwicker and E. Terhardt. Analytic expressions for critical band rate and critical bandwidth as a function of frequency. *J. Acoust. Soc. Am,* 68:1523–1525, 1980.]. The ISO-532B [for further information see ISO-532. BASIC Program for calculating the loudness of sounds from their ⅓-Oct band spectra according to ISO 532 B. *Acustica, Letters to the editors,* 55:63–67, 1984.]uses masking curve slopes from this method in a charting routine to calculate the spread of excitation.

In the second method, proposed by Moore and Glasberg [for further information see B. C. Moore, B. R. Glasberg, and T. Baer. A model for the prediction of thresholds, loudness, and partial loudness. *J. Aud. Eng. Soc.,* 45(4): 224–239, April 1997.], excitation patterns are generated from auditory filters. The auditory filter shapes determine the spread of excitation, not the masking patterns. The masking patterns reflect the use of multiple auditory filters, not a single auditory filter like the critical band. In Moore and Glasberg's method, the auditory filter shape is determined by finding the just noticeable tone level in a notch of noise.

Figure 5:
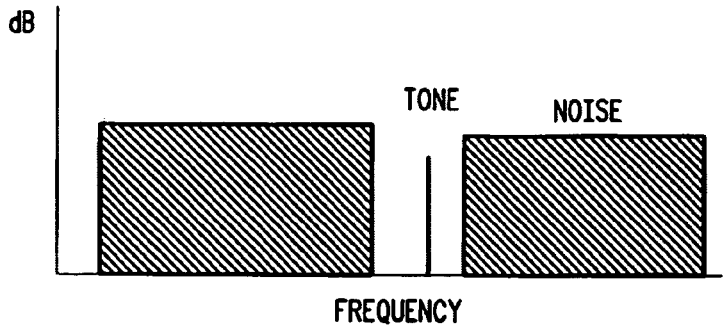
FIGS. 5–6 are graphs illustrating "notch noise" method to trace out auditory filter shapes.
Figure 6:
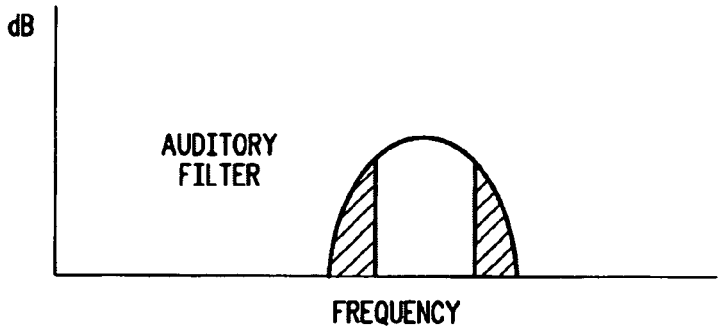

FIGS. 5–6 illustrate the "notch noise" method to trace out auditory filter shapes. Accordingly, FIGS. 5–6 show the notch noise method, which also appears to be less influenced by auditory events that contribute to the masking effects of Zwicker's method. The notch noise method, which allows variation of the notch center, favorably restricts analysis to a single auditory filter. Collectively, the auditory filter shapes are used to generate the excitation pattern, which can be considered as the output of the auditory filters as a function of their center frequency.

Figure 7:
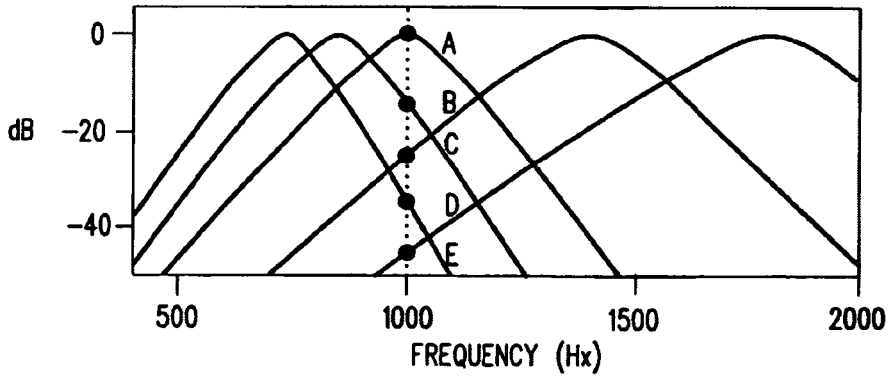
FIGS. 7–8 are graphs illustrating generation of excitation function, with FIG. 7 showing individual auditory filter shapes from a 1 KHz sinusoid input, and FIG. 8 showing resulting excitation pattern.
Figure 8:
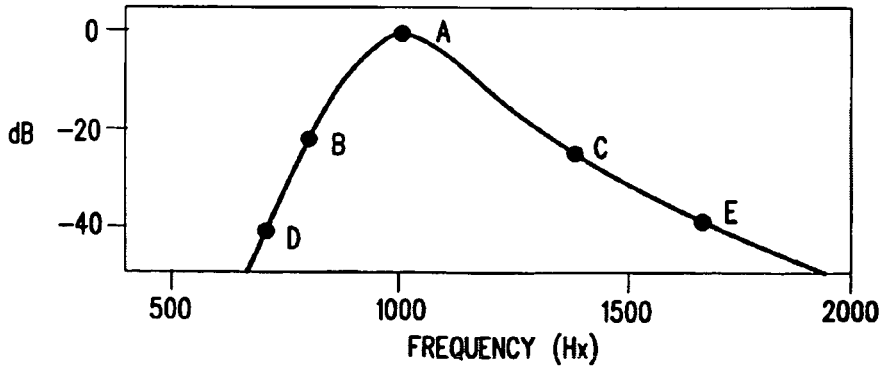

FIGS. 7–8 illustrate the generation of excitation function, with FIG. 7 showing individual auditory filter shapes from a 1 KHz sinusoid input, and FIG. 8 showing resulting excitation pattern. Accordingly, FIGS. 7–8 show the derived excitation pattern of a 1 KHz sinusoid tone from the simulated roex filters [for further information see Martin Pflueger, Robert Hoeldrich, and William Riedler. A nonlinear model of the peripheral auditory system. *IEM Report*, pages 1–10, February 1998.]. The evoked excitation is generated by the contributing outputs of the continuous auditory filter bank. The signal component falls within different auditory filters, each of which responds according to its filter shape. Although the auditory filters at this level are symmetrical on a linear frequency scale, the resulting excitation pattern is not. Auditory filter bandwidths increase with increasing frequency and are not linearly spaced. These characteristics generate the asymmetrical excitation functions which show a more pronounced upward spread of excitation [for further information see B. R. Glasberg and B. C. Moore. Derivation of auditory filter shapes from notched noise data. *Hearing Research,* 47:103–138, 1990.].

Experimental measurements of the auditory filter shapes using the noise notch method reveal the variation of shape with level [for further information see R. Hellman, A. Miskiewicz, and B. Scharf. Loudness adaptation and excitation patterns: Effects of frequency and level. *J. Acoust. Soc. Am,* 101(4)2176–2185, 1997.]. If the auditory filters were linear, then their shape would not change with the level of the input noise, which they do. These observations led to the inclusion of the level dependent term for calculating the upper auditory filter slopes in Eq (7), and as shown in FIG. 3.

Figure 9:
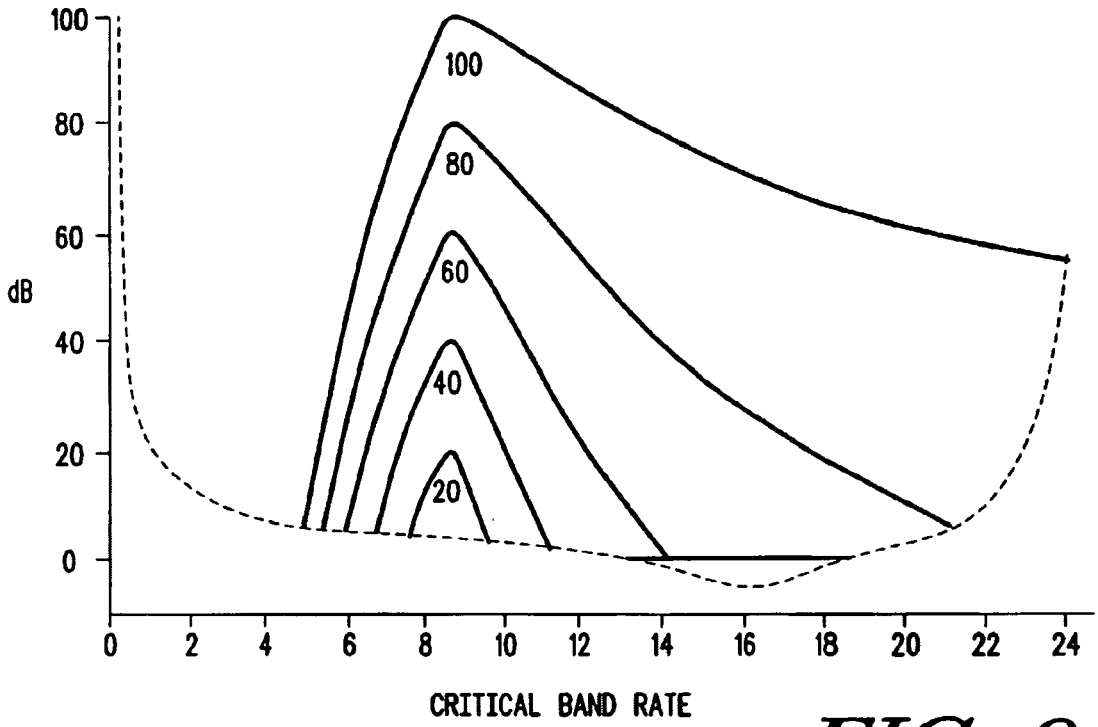
FIG. 9 is a graph illustrating excitation level versus critical band pattern for a 1 KHz tone generated by roex filters.

FIG. 9 illustrates the excitation level versus critical band pattern for a 1 KHz tone generated by roex filters. Accordingly, FIG. 9 shows the excitation patterns for various dB levels of a 1 KHz input sinusoid on a critical band scale. The excitations are generated from the outputs of the Roex auditory filters described by Eq (7) and calculated in the same manner as the excitation function of FIGS. 7–8. It can be seen that the excitation slopes of FIG. 9 are approximately linear with respect to power level on a critical band scale. The absolute threshold of hearing curve as the dashed line is described by Eq (20).

Power Law of Hearing

The total loudness, N, of a sound is produced by summing the specific loudnesses, N', along the critical band rate scale. The specific loudness components are incrementally added up along the critical band scale, similar to how the auditory system integrates loudness over frequency. The specific loudness is a function of the critical band rate, z, and is termed a "loudness distribution" or "loudness pattern". The loudness pattern produces a curve under which the area of the summation is a direct measure of perceived loudness.

$$N = \int_0^{24\,Bark} N' dz \tag{8}$$

Steven's law states sensations of intensity grow as a power law of physical intensity, and as a result, a relative change in loudness may be assumed proportional to a relative change in intensity [for further information see S. Stevens. The direct estimation of sensory magnitudes: loudness. *American Journal of Psychology,* 69:1–25, 1956.]. Loudness listening test experiments have shown that equal ratios of intensities lead to equal ratios of loudness estimates. Using specific loudness in place of total loudness and excitation in place of intensity, the following relation holds true:

$$\frac{\Delta N'}{N'} = k\frac{\Delta E}{E} \tag{9}$$

where the excitation E is an intermediate value which describes the masking contribution of the auditory filter slopes on a critical band rate. It provides a better approximation than intensity to our frequency selective hearing. Eq (9) represents an equation of differences which leads to the power law of hearing.

$$\int \frac{1}{N'} dN' = \int k\frac{1}{E} dE \tag{10}$$

$$\log N' = k \log E$$

$$N' = E^k$$

For low values of N1 and E, the internal noise floors can be included, $$N' + N_{gr} = (E + E_{gr})^k \tag{11}$$

Assuming the boundary condition that E=0 leads to N'=0, normalization by the noise floors is done.

$$\frac{N' + N_{gr}}{N_{gr}} = \left(\frac{E + E_{gr}}{E_{gr}}\right)^k \tag{12}$$

Solving for specific loudness, the equation $$N' = N_{gr}[(1 + E/E_{gr})^k - 1]$$ Eq. (13) is realized.

$N_0$ is necessary as a reference specific loudness to $N_{gr}$, and $E_0$ is the reference excitation produced by a sound at 0 dB SPL.

$$\frac{N'_{gr}}{N_0} = \left(\frac{E_{gr}}{E_0}\right)^k \quad \text{Eq (14)}$$

The threshold factor, s, is included to use the hearing threshold in quiet produced by the internal excitation noise, as shown below.

$$E_{gr} = E_{TQ}/S \quad \text{Eq (15)}$$

Inserting these substitutions in Eq (13) provides the final loudness equation:

$$N' = N'_0\left(\frac{E_{TQ}}{sE_0}\right)^k\left[\left(1 + \frac{sE}{E_{TQ}}\right)^k - 1\right] \quad \text{Eq (16)}$$

For moderate to high levels of excitation E the influence of $E_{TQ}$ is negligible and specific loudness can be simplified as shown below.

$$N' \approx N_0\left(\frac{E}{E_0}\right)^k \quad \text{Eq (17)}$$

Zwicker and colleagues found k=0.23 to provide the best fit to observed results from pure tone masked by narrowband noise experiments. For k=0.3 the compressive non-linearity provides a close fit to tones, and for k=0:23 it is a close fit to noise maskers [for further information see E. Zwicker and H. Fastl. *Psychoacoustics*. Springer Series, Berlin, 1998.]. Equations (11) through (16) are provided to better match the loudness measurements in low intensity conditions where rapid changes in loudness occur. Eq (16) is a modification of the general power law to include low level loudness calculations. For moderate to high levels of E the additional terms are negligible. At low levels, it accounts for the steep drop in observed loudness near threshold. Moore et al. [for further information see B. C. Moore, B. R. Glasberg, and T. Baer. Revision of Zwicker's loudness model. *Acustica,* 82:335–445, 1996.] have modified the loudness equation of Eq (16) to more suitably represent hearing selectivity at levels near quiet, as follows:

$$N' = c\left[\left(\frac{E}{E_0}\right)^k - \left(\frac{E_{TQ}}{E_0}\right)^k\right] \text{ for } E \geq E_{TQ} \quad \text{Eq (18)}$$

In this equation, loudness approaches zero as E approaches $E_{TQ}$ and becomes zero when the excitation reaches threshold. There are two favorable consequences to this simple modification of the loudness equation. The steep drop in observed loudness near threshold is accounted for in the equation, meaning low levels near threshold are better modeled in regards to experimental loudness measurements [for further information see B. C. Moore, B. R. Glasberg, and T. Baer. Revision of Zwicker's loudness model. *Acustica,* 82:335–445, 1996.]. This allows for the rapid growth of loudness in high threshold regions, such as the low frequency regions. Further, as the excitation increases, the threshold is also almost negligible in the calculation.

Outer to Inner Ear Filter

The frequency selectivity of the outer to middle ear is intimately related to the perception of loudness. The first stage of a loudness model is to include the transfer characteristics of the outer to middle ear. The outer ear transmission includes the form of the head, the outer ear, and the outer canal which provides our high frequency sensitivity. The middle ear begins with the eardrum and acts as a pressure receiver to convert sound intensities to physical movements.

The intensity of sound is a small air force oscillation over a large displacement, and the required physical movements are large forces over small areas. The physical movements are conveyed to the inner ear where physical motion is converted to wave motions. This complete interaction defines an impedance-matched transformation which is extremely efficient in the human auditory system. This transmission is denoted the outer to middle ear transfer function, and is normally introduced as a logarithmic attenuation curve $A_0$. It represents the transmission characteristics the sound undergoes as it travels from the free field to that sound being active internally, as shown below.

$$H(z) = H_{LP}(z)H_{HP}(z) \qquad \text{Eq (19)}$$

$$H_{HP}(z) = \frac{1 - 2z^{-1} + z^{-2}}{1 - 2Rz^{-1} + R^2z^{-1}}$$

$$H_{LP}(z) = \frac{0.109(1 + z^{-1})}{1 - 2.539z^{-1} + 3.9295z^{-2}} - 4.7532z^{-3} + 4.7251z^{-4} - 3.5548z^{-5} + 2.1396z^{-6} - 0.9879z^{-7} + 0.2836z^{-8}$$

The outer to middle transfer function has been modeled from experimental listening test results and measurements. Several authors have shown adjustments to the equal loudness contours published in ISO-226. A parameterized model of the outer to middle transfer function has been proposed by Pflueger et al. [for further information see Martin Pflueger, Robert Hoeldrich, and William Riedler. A nonlinear model of the peripheral auditory system. *IEM Report*, pages 1–10, February 1998.] and given in Eq (19) for f s=44.1 KHz to account for the deviations with the parameter R. The responses model a general set of attenuation curves $A_0$ between the inverted 100 phon equal loudness contour (topmost) and the inverted absolute threshold of hearing curve (bottommost). The transmission is characterized by the cascade of a low pass filter and a high pass filter. The 8th order IIR LPF determines the overall shape, and the high pass filter determines the low frequency attenuation. The R factor sets the low frequency response below 1 Khz.

Figure 10:
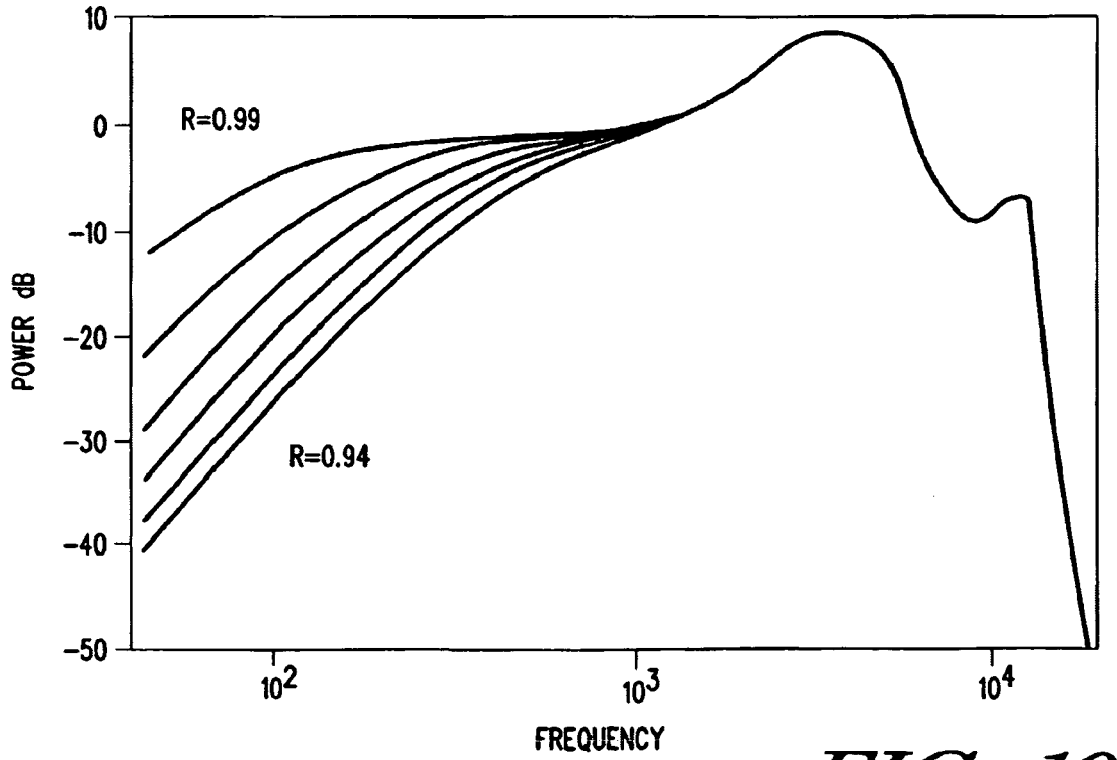
FIG. 10 is a graph illustrating outer to middle ear filter given by Eq (19) for various values of R.

FIG. 10 illustrates the outer to middle ear filter given by Eq (19) for various values of R. Accordingly, FIG. 10 shows the filter at values of R=0.94 to 0.99 in increments of 0.10 for fs=44.1 KHz. Zwicker's model of loudness assumes an outer to middle ear transfer function which was flat below 2 Khz, and followed the form of the inverted absolute threshold curve above 2 Khz. This model assumes that the low frequency thresholds below 2 Khz were the complete result of internal low-frequency noise, and therefore the attenuation should not reflect the elevated threshold in this region. In Moore and Glasberg's model, the assumed transmission function from the outer to the middle ear is based on the inverted 100 phon equal-loudness contour for frequencies below 1 Khz, and on the inverted absolute threshold curve for frequencies above 1 Khz. This is based on the assumption that the inner ear has an internal noise floor which rises with level in accord with the outer to middle ear transmission. This allows the internal noise floor to rise with level similarly to the inverted equal loudness levels.

Zwicker assumed no low frequency noise floor, and the low frequency threshold increase was strictly due to increasing internal noise with level. Like Zwicker, Moore and Glasberg also assume the inner ear is equally sensitive to frequencies above 1 KHz. They propose a filter shape in this region as the inverted absolute threshold curve. The 100 phon and absolute threshold curve on which the Minimum Audible Field (MAF) is based are also approximately equivalent above 1 Khz.

The absolute threshold of hearing can also be approximated by the following equation where f is expressed in KHz [for further information see R. Hellman, A. Miskiewicz, and B. Scharf. Loudness adaptation and excitation patterns: Effects of frequency and level. *J. Acoust. Soc. Am,* 101(4):2176–2185, 1997.].

$$A_{dB}(f)=3.64f^{-0.8}-6.5e^{-0.6[(f-3.3)^2]}+10^{-3}(f^4) \qquad \text{Eq (20)}$$

Loudness and Bandwidth

Moore and Glasberg's model of loudness addresses the following changes to Zwicker's model: 1) reexamination of the low frequency attenuations in the outer to middle ear filter 2) the evaluation of excitations based on analytic expressions of asymmetric level dependent auditory filters; and 3) to account for the loudness growth near quiet by the proposed relation of specific loudness to excitation in Eq (18). Moore and Glasberg's revision of Zwicker's loudness model was introduced to better account for the way that equal loudness contours change with level. Their model also provides a good explanation as to why the loudness of a sound of fixed intensity remains constant when the sound has a bandwidth less than the critical bandwidth.

Zwicker's experimental results concluded that loudness was independent of bandwidth for bandwidths less than the critical bandwidth. Further, when the bandwidth exceeds a critical band, loudness increases. Zwicker's model of loudness assumes excitation patterns for all sounds within a critical band are the same [for further information see B. C. Moore, B. R. Glasberg, and T. Baer. Revision of Zwicker's loudness model. *Acustica,* 82:335–445, 1996.]. The excitation patterns were obtained from masking patterns of pure tones masked by narrowband noises. Moore and Glasberg's model derives excitation patterns from auditory filter responses whose shapes were derived from data obtained by noise notch experiments. Their description of the excitation pattern through auditory filter analysis provides an alternate view: loudness remains constant below a critical bandwidth not because the excitations are identical, but because the total specific loudness due to excitation is constant. When the bandwidth exceeds a critical band, the contribution of the specific loudness due to broadening of the excitation increases. The area increase from the broadening of the excitation is greater than the area decrease in effective amplitude. Thus, the contribution of the specific loudnesses is greater as compared to when the bandwidth was less than the critical band.

For illustration, the simulation results [for further information see B. C. Moore, B. R. Glasberg, and T. Baer. Revision of Zwicker's loudness model. *Acustica,* 82:335–445, 1996.] are replicated using the auditory filters of Eq (7).

Figure 11:
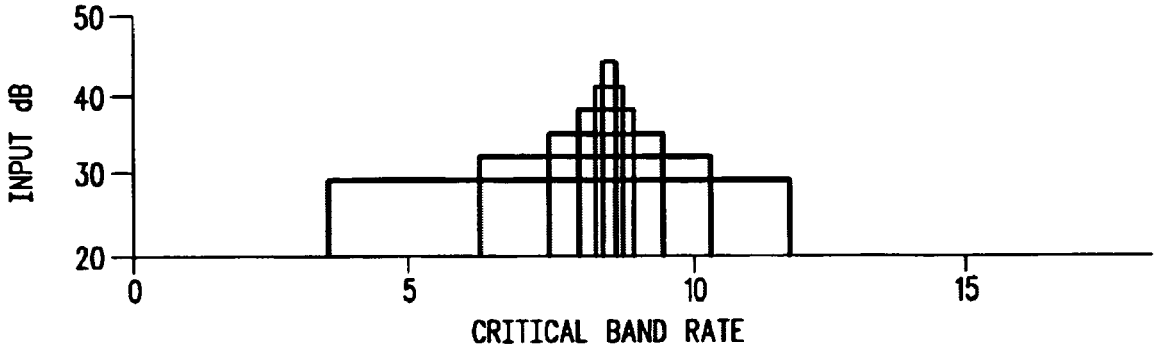
FIGS. 11–13 are graphs illustrating a relation between loudness and bandwidth, with FIG. 11 showing input narrowband noise centered at 1 KHz with bandwidths of 40, 80, 160, 320, 640 and 1280 Hz (all at a constant level of 60 dB SPL), FIG. 12 showing corresponding excitation patterns, and FIG. 13 showing resulting loudness pattern.
Figure 12:
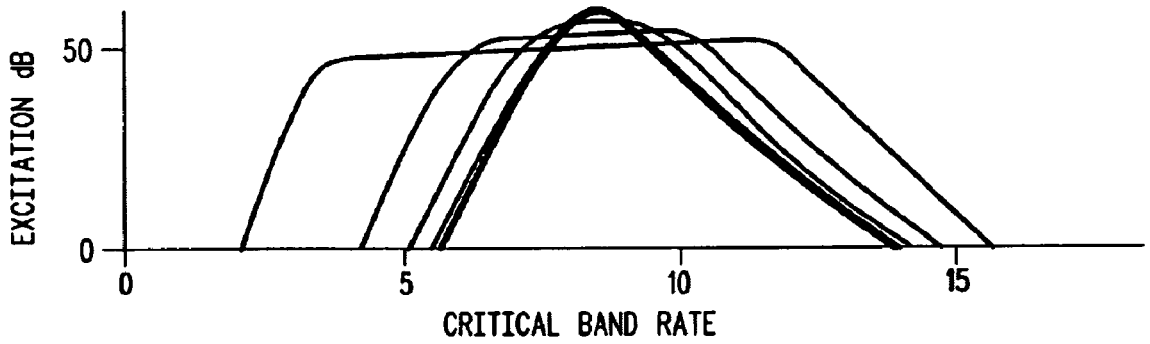
Figure 13:
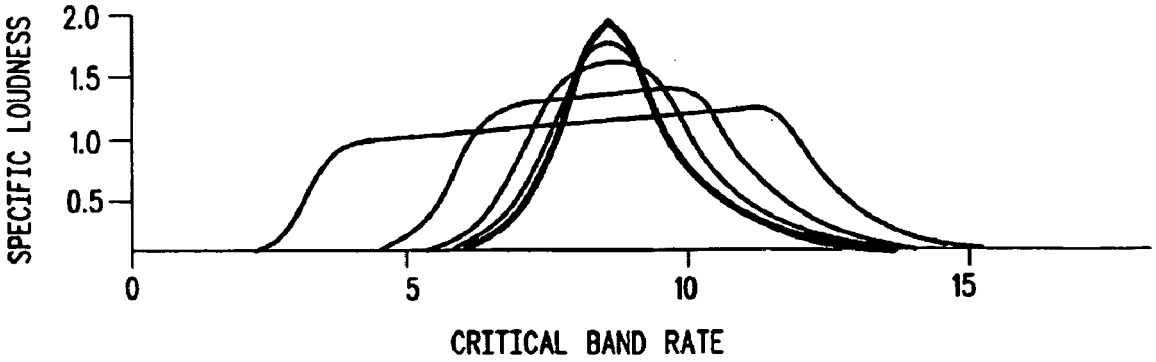

FIGS. 11–13 illustrate the relation between loudness and bandwidth, with FIG. 11 showing input narrowband noise centered at 1 KHz with bandwidths of 40, 80, 160, 320, 640 and 1280 Hz (all at a constant level of 60 dB SPL), FIG. 12 showing corresponding excitation patterns, and FIG. 13 showing resulting loudness pattern. Accordingly, FIGS. 11–13 show the excitation and loudness patterns of narrowband noise centered at 1 KHz with bandwidths of 40, 80, 160, 320, 640 and 1280 Hz: all at a constant overall level of 60 dB SPL. As can be seen from FIGS. 11–13, for bandwidths between 20 and 160 Hz, the decrease in specific loudness area below the peak is about the same as the slight increase along the skirts. In this range the total area, or loudness, is relatively constant. For bandwidths above 160 Hz (the critical bandwidth of a 1 KHz tone), the increase in specific loudness area along the skirts due to the excitation broadening is greater than the decrease in area below the peak. In this case, the loudness increases. Moore and Glasberg's model provide predictions of loudness close to empirically obtained results, and more accurate than those of Zwicker's model [for further information see B. C. Moore, B. R. Glasberg, and T. Baer. Revision of Zwicker's loudness model. *Acustica,* 82:335–445, 1996.]. Their model provides an emphasis on the frequency selectivity of the hearing system, and has shown success at predicting the variation of loudness with respect to intensity, frequency, and bandwidth.

Figure 14:
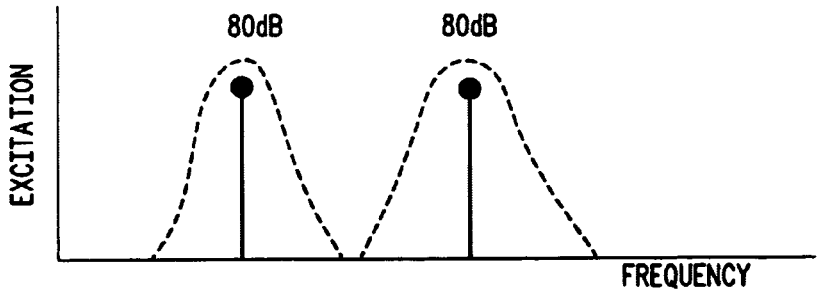
FIGS. 14–15 are graphs illustrating loudness of two tones of equal energy, with FIG. 7 showing two tones separated by more than a critical band, and FIG. 8 showing two tones of the same critical band.
Figure 15:
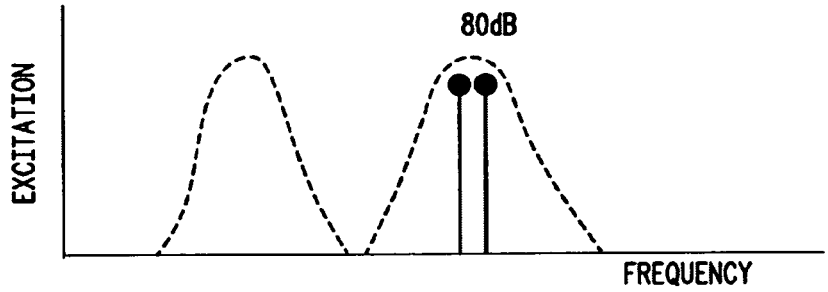

FIGS. 14–15 illustrate the loudnesses of two tones of equal energy, with FIG. 7 showing two tones separated by more than a critical band, and FIG. 8 showing two tones of the same critical band. Accordingly, FIGS. 14–15 show that the loudness of two tones separated by a critical band sounds twice as loud as the sum intensity of the two tones within a critical band. Critical bands act as independent processing channels [for further information see William Hartmann. *Signals, Sound, and Sensation*. Springer, New York, 1998.]. As a result, loudness is dependent not only on signal level and bandwidth, but also frequency. A simple example serves to show the power of critical band separation on perceived loudness. FIGS. 14–15 demonstrate the loudness of two tones of equal energy at 80 dB for a) being separated by more than a critical band, and b) being within the same critical band.

For illustration, Table 1 (listed below) shows the loudness of FIGS. 14 and 15 respectively using the power law of hearing, where I is intensity, E is excitation, and c is a constant. The loudness of two tones at equal power separated by more than a critical band are twice as loud as the two tones within a critical band. This suggests that perceived loudness can be increased without adding energy using psychoacoustic signal modeling techniques.

The compressive nonlinearity described by power law of hearing reveals that the loudness of two tones separated by a critical band will be louder than the two tones within a critical band. Interestingly, the loudness of the two tones is roughly double when separated by a critical band. This demonstrates the concept of loudness additivity in which two equally loud tones that do not mask each other can sound twice as loud when presented together [for further information see H. Fletcher and W. J. Munson. Loudness, its definition, measurement, and calculation. *J. Acoust. Soc. Am,* 5:82–108, 1933.]. This establishes the biological premise and motivation to increase loudness without altering signal energy.

TABLE 1

Effect of critical band separation on the loudness of two tones described by the power law of hearing.

| FIG. 14 | FIG. 15 |
|---|---|
| $I = 10^{80/10}$ | $I = 10^{80/10}$ |
| $E = 10 \log_{10} I$ | $E = 10 \log_{10} (2I)$ |
| $\psi = 2.\ cE^{0.3}$ | $\psi = cE^{0.3}$ |
| $\psi = 7.4\ c$ | $\psi = 3.7\ c$ |

Implementation Embodiment in Hardware

Figure 16:
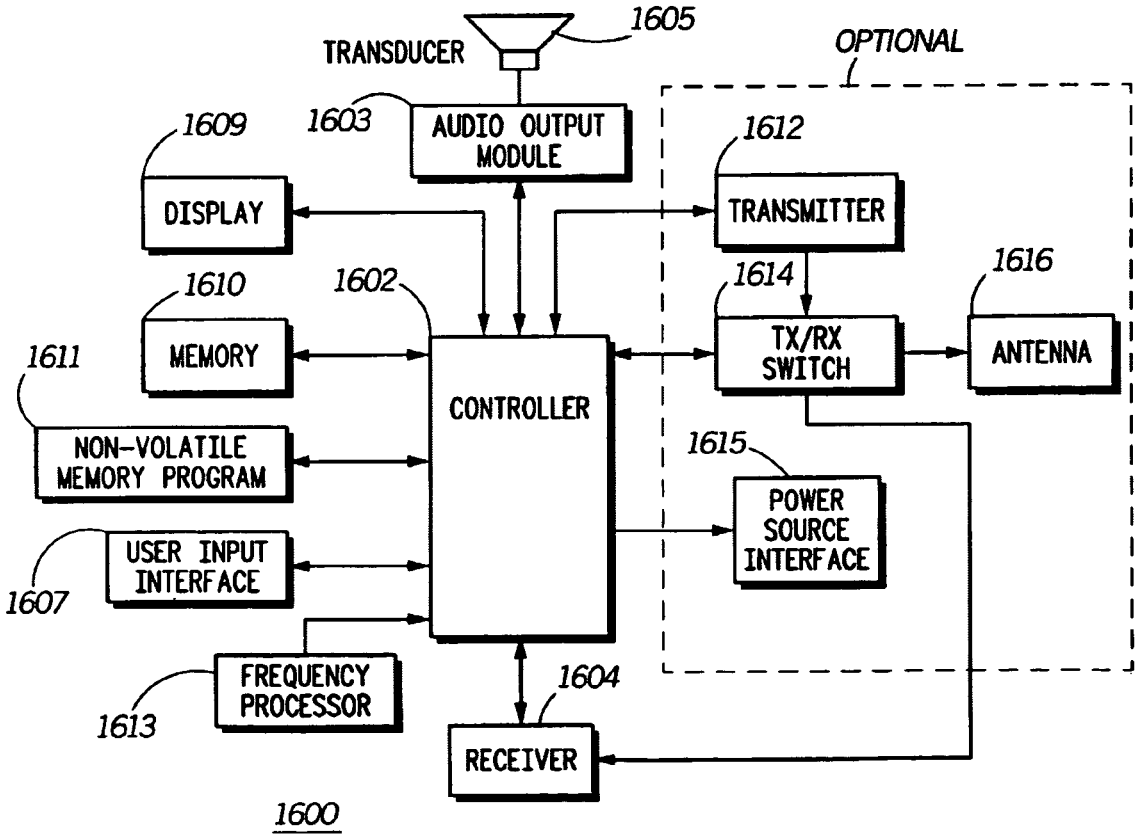
FIGS. 16 and 17 are block diagrams of an end user device for implementing the method, according to the present invention.
Figure 17:
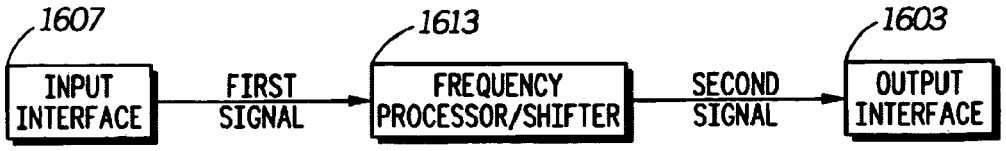

FIGS. 16 and 17 show the block diagrams for implementing the method of the present invention. The end user device 1600 includes a controller 1602, a memory 1610, a non-volatile (program) memory 1611 containing pre-defined configuration routines. The end user device 1600 also includes other units for implementing the method of the present invention, as described below.

In "receive" mode, the controller 1602 couples an antenna 1616 through a transmit/receive (TX/RX) switch 1614 to a receiver 1604. The receiver 1604 decodes the received signals and provides the decoded signals to the controller 1602. In "transmit" mode, the controller 1602 couples the antenna 1616, through the switch 1614 to a transmitter 1612. The controller 1602 operates the transmitter 1612 and receiver 1604 according to instructions stored in the program memory 1611.

Further, the controller 1602 is coupled to an user input interface unit 1607 (such as a key board), a display unit 1609 (such as a liquid crystal display), the memory 1610, a frequency processor 1613, an audio output module 1603, a transducer 1605, and to a non-illustrated power source through a power source interface 1615.

The following units can realize the reception/transmission of signals via the antenna 1616: a power amplifier, a driving amplifier, an up/down converter, a buffer, an automatic gain control amplifier, and a radio frequency band pass filter. The power amplifier amplifies signals to transmit the amplified signals to a base station via the antenna. The drive amplifier provides the power amplifier with signals to effectively perform the amplification. The up/down converter shifts (up/down) the frequencies upon transmission/reception. Further structural details of the units are foregone herewith for clarity.

The user input unit 1607 has several keys (including function keys) for performing various functions. The input unit 1607 outputs data (to the controller 1602) based on the keys depressed by the user. Accordingly, the controller 1602 fetches the program instructions stored in the program memory 1611 and executes the program instructions. The display unit 1609 is used for displaying the status of the end user device and the progress of the program being executed by the controller 1602.

The user is presented with a pre-defined configuration routine (at step 2304) of tones by the controller 1602. When the first tone that is presented (via the audio output module 1603 and transducer 1605 is not satisfying to the user, the user informs the controller 1602 via the keyboard 1607 that the user needs more choice. Then, the controller 1602 again executes the program instructions stored in the program memory 1611. The next frequency stored in the configuration routine for the audio signal is processed by the frequency processor/shifter 1113, and the user is presented (via the audio output module 1603 and the transducer 1605) with the corresponding audio tone. Accordingly, the user is presented with the pre-defined configuration routine (at step 1604) of tones until the user selects the user's preferred tone or the configuration routine is exhausted. This procedure is performed iteratively according to the configuration routine. At step 1606, the controller 1102 receives the user's selection, thereby acquiring the user's profile (step 1608). This way, the power/energy of the power source required for generating a given tone is conserved.

FIG. 17 shows the above-operation of the present invention in a simple manner.

Figure 19:
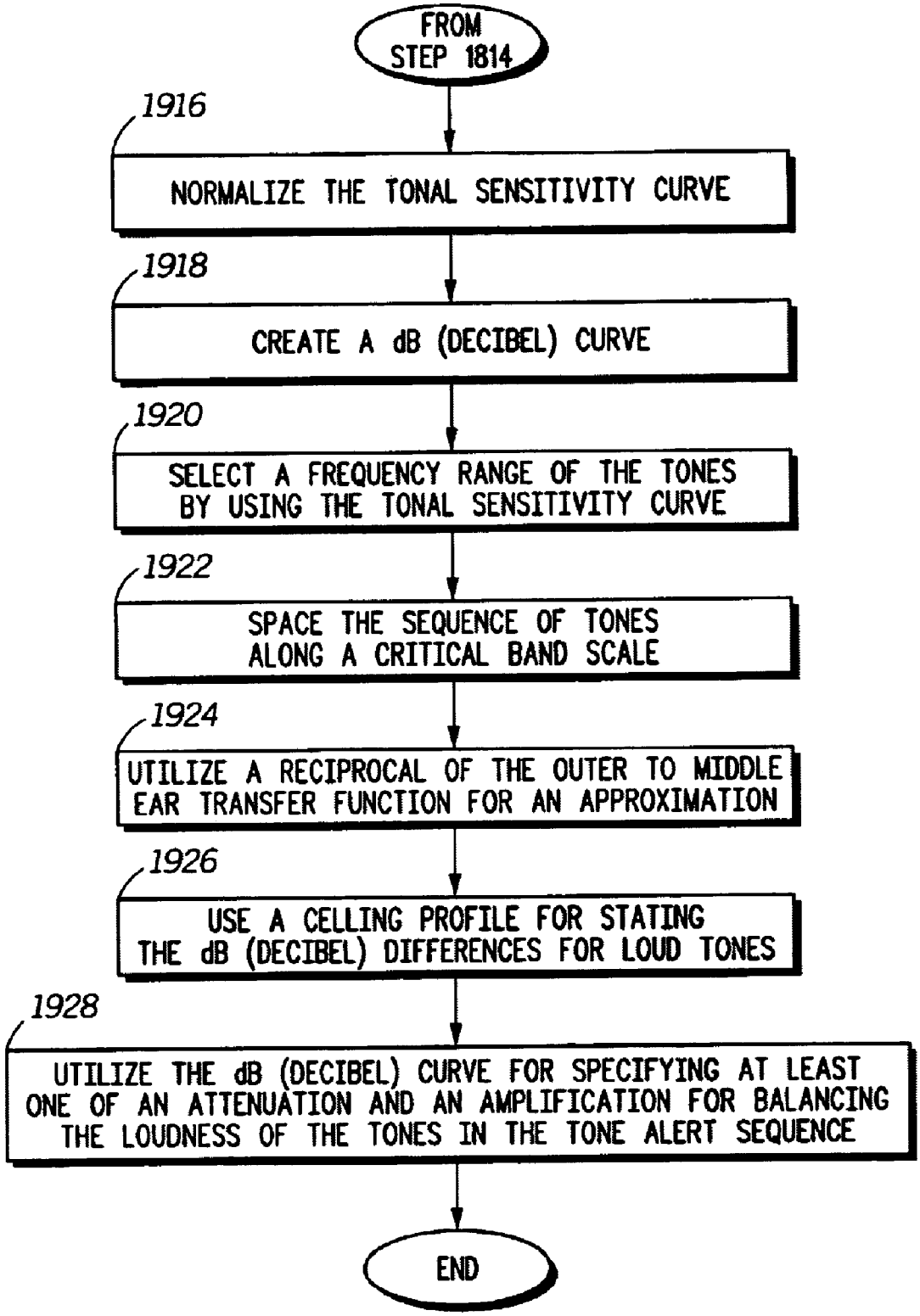
Figure 20:
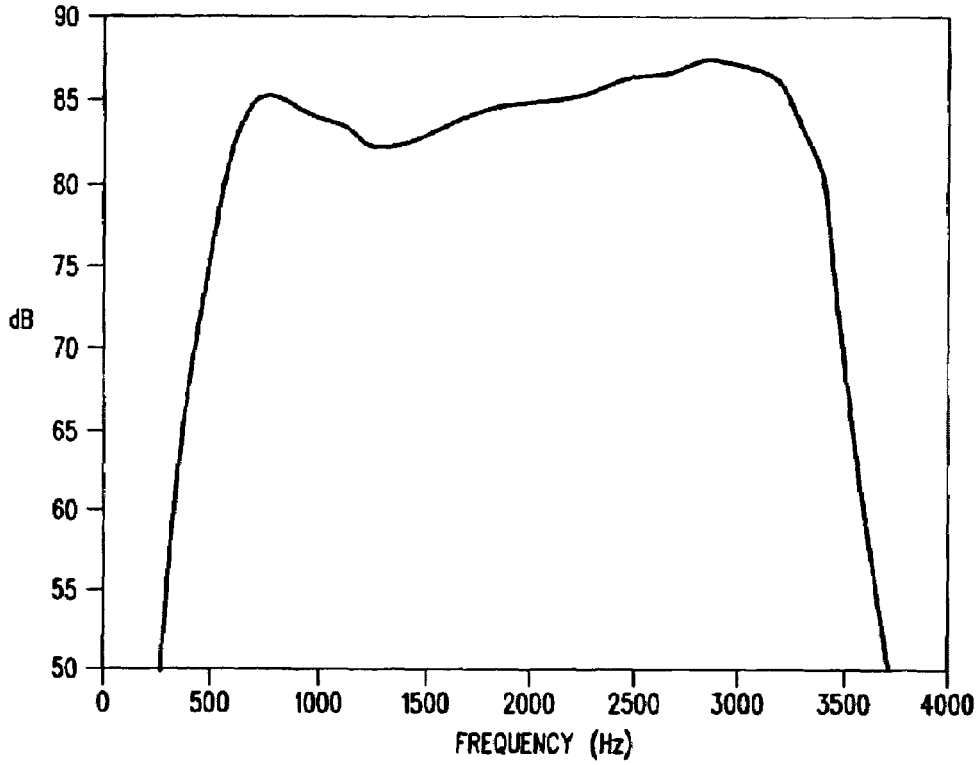
FIG. 20 is a graph illustrating an audio speaker frequency response curve, according to the present invention.

FIG. 19 is a flow diagram showing the method, operating on the end user of FIG. 11, according to the present invention. Accordingly, FIG. 19 illustrates an operational flow chart according to one embodiment of the present invention. The method involves, at step 1800, generating an audio speaker frequency response curve for a given volume setting and speaker (as shown in FIG. 20). Different volume levels give slightly different frequency responses. They are dependent on the mechanical housing and speaker characteristics.

Figure 21:
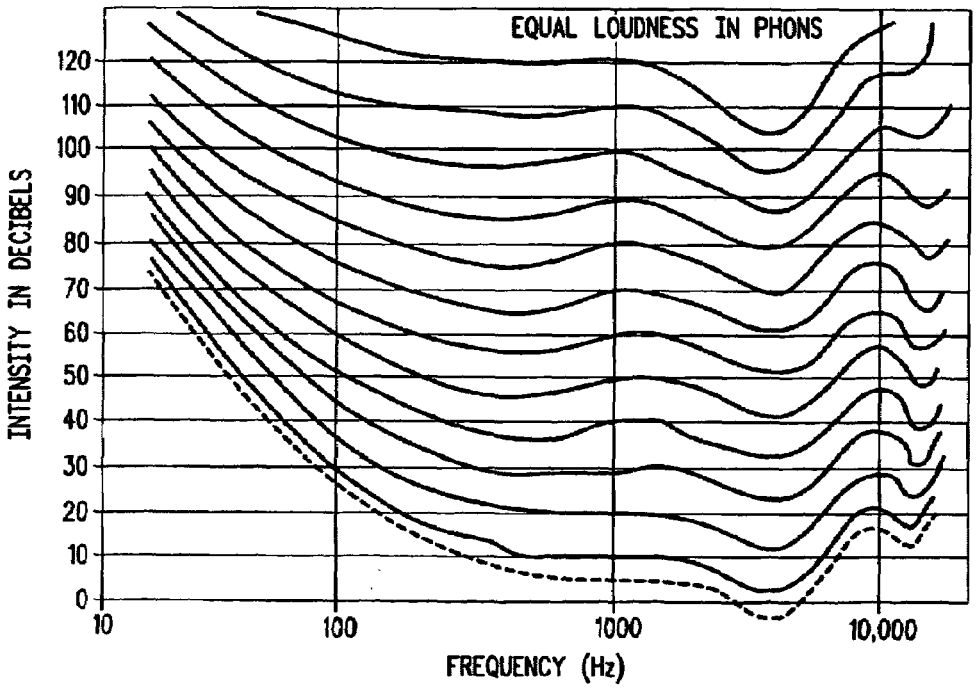
FIG. 21 is a graph illustrating ISO-226 equal loudness curve, according to the present invention.

At step 1802, an equal loudness (corresponding to the lowest frequency response dB level in the 3-dB bandwidth range of the frequency response curve) reference curve is selected (as shown in FIG. 21). This is the loudness reference curve. In this embodiment, the 80 phon equal loudness curve of FIG. 21 is used along with FIG. 20. At step 1804, the loudness reference curve from the audio speaker frequency response curve is subtracted.

Figure 22:
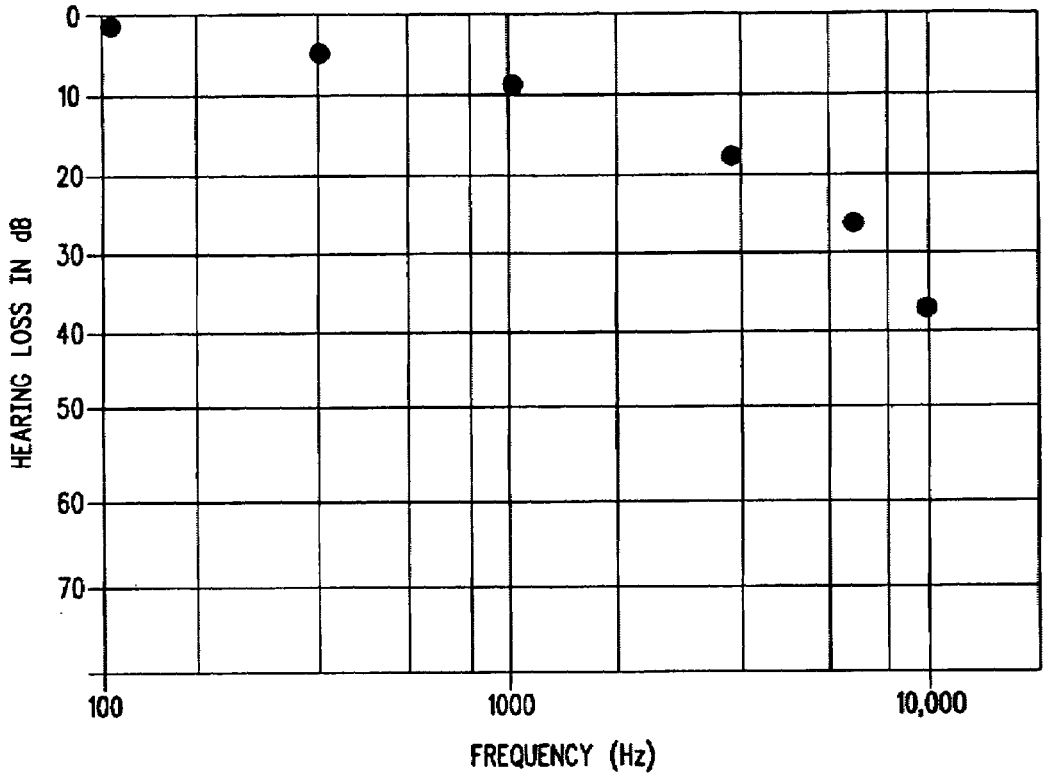
FIG. 22 is a graph illustrating a listener's audio profile, according to the present invention.
Figure 23:
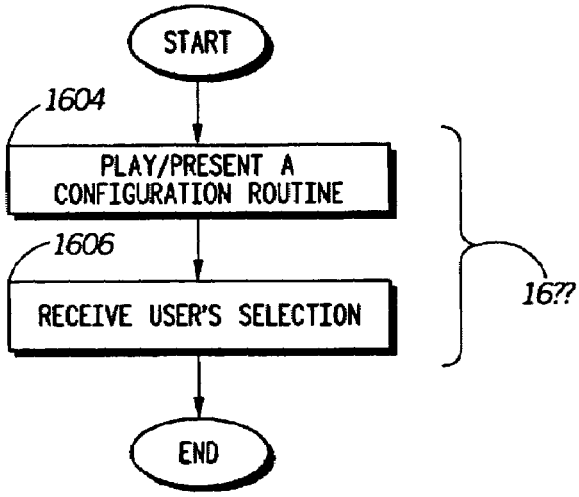
FIG. 23 is a flow diagram showing the method of customizing the listener's profile of FIG. 19, according to the present invention.

At step 1806, a loudness sensitivity curve for a given audio speaker response is created. At step 1808, the method entails acquiring a listener's threshold audio profile (as shown in FIG. 22). The step of acquiring the listener's threshold audio profile involves playing a pre-defined configuration routine (at step 2304), and receiving the listener's selection (at step 2306). This is illustrated in FIG. 23.

The listener's threshold audio profile indicates the listener's hearing acuity in terms of tone thresholds and further indicates the dB gain necessary for the listener for hearing certain tones. A ceiling profile can also be used which states the dB differences for loud tones. A normal hearing listener has a flat 0 dB response.

At step 1810, the listener's audio profile to the loudness sensitivity curve is added. The audio profile contains all positive values (as shown in FIG. 22). If it is a normal hearing listener, this step is not required. The resulting curve specifies the listener's tonal sensitivity (Accordingly, at step 1812, the method entails generating the listener's tonal sensitivity curve—if an abnormal-hearing listener).

Figure 18:
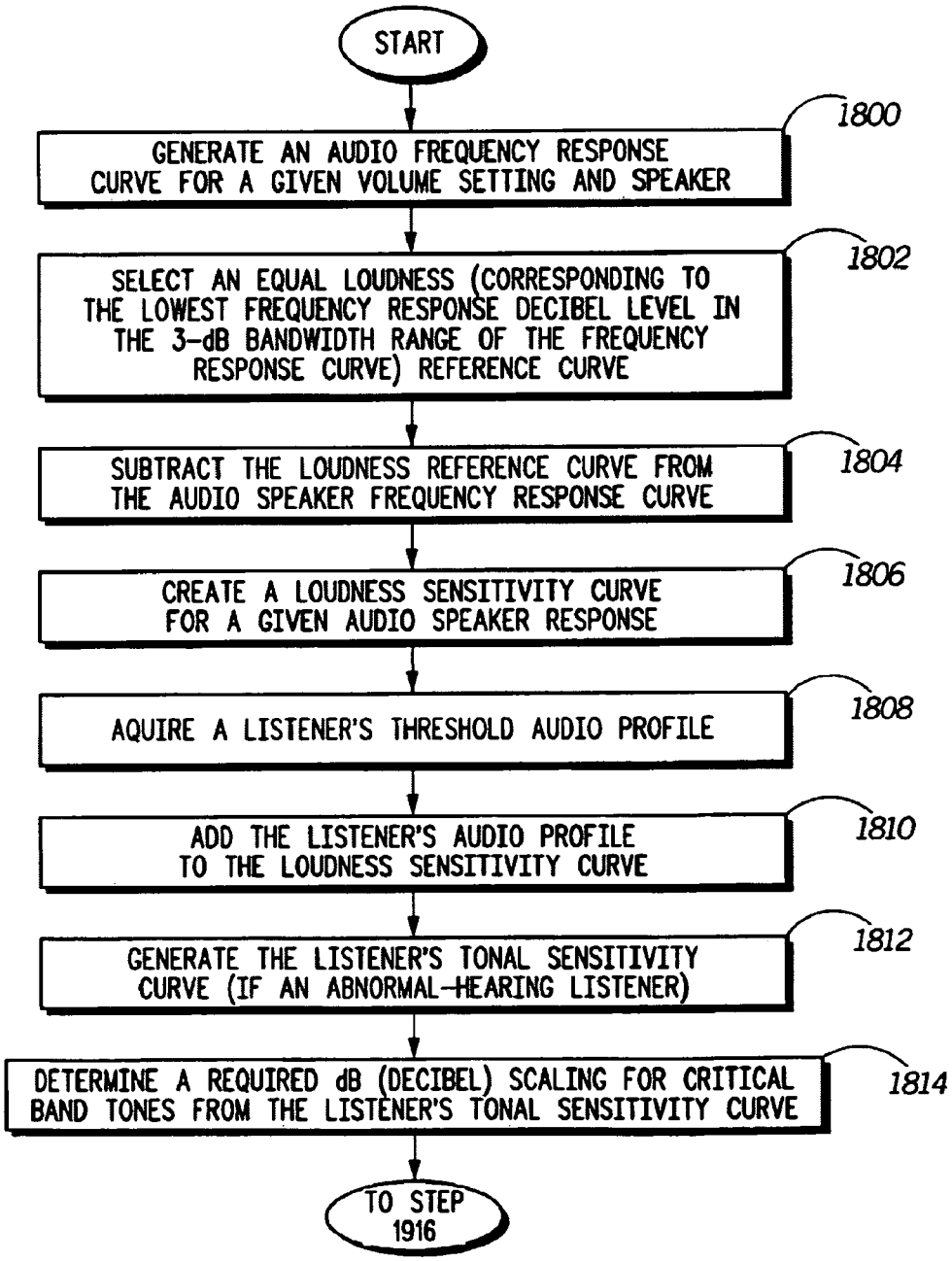
FIGS. 18 and 19 are flow diagrams showing the method, operating on the end user of FIG. 16, according to the present invention.

At step 1814, the method includes determining a required dB scaling for critical band tones from the listener's tonal sensitivity curve. FIG. 19 is a flow diagram that continues the method, operating on the end user of FIG. 18, according to the present invention. At step 1916, the tonal sensitivity curve is normalized. At step 1918, a dB (decibel) curve is created. The resulting dB curve specifies how much attenuation or amplification is necessary to balance the loudness of the tones in the tone alert sequence.

At step 1920, a frequency range of the tones (by using the tonal sensitivity curve) is selected. At step 1922, the method involves spacing the sequence of tones along a critical band scale. This is how optimal loudness is achieved. Table 2 illustrates this clearly. For example, if the range 1 KHz to 2 KHz is selected, which corresponds to critical bands 9 through 13, then 5 tones are required at 1000, 1170, 1370, 1600, and 1850 HZ. The relative amplitudes are based on the dB scaling from the listener's tonal sensitivity curve.

TABLE 2

| | Achieving optimal loudness | | |
|---|---|---|---|
| Critical band # | frequency (Hz) | bandwidth (Hz) | Center freq. (Hz) |
| 1 | 100 | 100 | 50 |
| 2 | 200 | 100 | 150 |
| 3 | 300 | 100 | 250 |
| 4 | 400 | 100 | 350 |
| 5 | 510 | 110 | 450 |
| 6 | 630 | 120 | 570 |
| 7 | 770 | 140 | 700 |
| 8 | 920 | 150 | 840 |
| 9 | 1080 | 160 | 1000 |
| 10 | 1270 | 190 | 1170 |
| 11 | 1480 | 210 | 1370 |
| 12 | 1720 | 240 | 1600 |
| 13 | 2000 | 280 | 1850 |
| 14 | 2320 | 320 | 2150 |
| 15 | 2700 | 380 | 2500 |
| 16 | 3150 | 450 | 2900 |
| 17 | 3700 | 550 | 3400 |
| 18 | 4400 | 700 | 4000 |
| 19 | 5300 | 900 | 4800 |
| 20 | 6400 | 1100 | 5800 |
| 21 | 7700 | 1300 | 7000 |
| 22 | 9500 | 1800 | 8500 |
| 23 | 12000 | 2500 | 10500 |
| 24 | 15500 | 3500 | 13500 |

The method further preferably involves, at step 1224, using a reciprocal of the outer to middle ear transfer function for an approximation. Step 1226 involves utilizing a ceiling profile for stating the dB differences for loud tones. The method further involves, at step 1228, utilizing the dB (decibel) curve for specifying the attenuation and/or amplification necessary for balancing the loudness of the tones in the tone alert sequence.

Non-Limiting Hardware Embodiments

The present invention can be realized in hardware, software, or a combination of hardware and software. A system according to a preferred embodiment of the present invention can be realized in a centralized fashion in one computer system, or in a distributed fashion where different elements are spread across several interconnected computer systems. Any kind of computer system—or other apparatus adapted for carrying out the methods described herein—is suited. A typical combination of hardware and software could be a general purpose computer system with a computer program that, when being loaded and executed, controls the computer system such that it carries out the methods described herein.

The present invention can also be embedded in a computer program product, which comprises all the features enabling the implementation of the methods described herein, and which—when loaded in a computer system—is able to carry out these methods. Computer program means or computer program in the present context mean any expression, in any language, code or notation, of a set of instructions intended to cause a system having an information processing capability to perform a particular function either directly or after either or both of the following a)

conversion to another language, code or, notation; and b) reproduction in a different material form.

Each computer system may include, inter alia, one or more computers and at least a computer readable medium allowing a computer to read data, instructions, messages or message packets, and other computer readable information from the computer readable medium. The computer readable medium may include non-volatile memory, such as ROM, Flash memory, Disk drive memory, CD-ROM, and other permanent storage. Additionally, a computer medium may include, for example, volatile storage such as RAM, buffers, cache memory, and network circuits. Furthermore, the computer readable medium may comprise computer readable information in a transitory state medium such as a network link and/or a network interface, including a wired network or a wireless network, that allow a computer to read such computer readable information.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. In an end user device, a method for increasing the audio perceptual loudness, the method comprising:

shifting at least one frequency of a first audio signal by at least one critical band distance along a critical band scale to create a second audio signal so as to increase the audio perceptual loudness, a power level of the second audio signal being not more than a power level of the first audio signal;

generating high-audio perceptual loudness tone alert sequences based on psychoacoustic and audiometric data;

generating an audio speaker frequency response curve for a given volume setting and speaker;

selecting an equal loudness reference curve corresponding to a lowest frequency response dB level in a 3-dB bandwidth range of the frequency response curve; and creating a loudness sensitivity curve for a given audio speaker response by subtracting the equal loudness reference curve from the audio speaker frequency response curve.

2. The method of claim 1, further comprising:

acquiring a listener's threshold audio profile;

adding the listener's audio profile to the loudness sensitivity curve for producing the listener's tonal sensitivity curve;

determining a required dB scaling for critical band tones from the listener's tonal sensitivity curve; and normalizing the tonal sensitivity curve for creating a dB curve.

3. A computer readable medium comprising computer instructions for increasing the audio perceptual loudness, comprising:

shifting at least one frequency of a first audio signal by at least one critical band distance along a critical band scale to create a second audio signal so as to increase the audio perceptual loudness, a power level of the second audio signal being not more than a power level of the first audio signal;

generating high-audio perceptual loudness tone alert sequences based on psychoacoustic and audiometric data generating an audio speaker frequency response curve for a given volume setting and speaker;

selecting an equal loudness reference curve corresponding to a lowest frequency response dB level in a 3-dB bandwidth range of the frequency response curve; and creating a loudness sensitivity curve for a given audio speaker response by subtractine the equal loudness reference curve from the audio speaker frequency response curve.

4. The computer readable medium of claim 3, further comprising computer instructions for:

acquiring a listener's threshold audio profile;

adding the listener's audio profile to the loudness sensitivity curve for producing the listener's tonal sensitivity curve;

determining a required dB scaling for critical band tones from the listener's tonal sensitivity curve; and normalizing the tonal sensitivity curve for creating a dB curve.

5. The computer readable medium of claim 4, wherein the listener's threshold audio profile indicates the listener's hearing acuity in terms of tone thresholds and further indicates the dB gain necessary for the listener for hearing given tones.

6. The computer readable medium of claim 3, further comprising computer instructions for:

using a ceiling profile for stating dB differences for increased audio perceptual tones.

7. An end user device for increasing the audio perceptual loudness, comprising:

an input interface for inputting a first audio signal;

a frequency shifter/processor coupled to the input interface for shifting/processing at least one frequency of the first audio signal by at least one critical band distance along a critical band scale to create a second audio signal so as to increase the audio perceptual loudness, a power level of the second audio signal being not more than a power level of the first audio signal; and an output interface coupled to the frequency shifter/processor for outputting the second audio signal;

means for generating high-audio perceptual loudness tone alert sequences based on psychoacoustic and audiometric data;

means for generating an audio speaker frequency response curve for a given volume setting and speaker;

means for selecting an equal loudness reference curve corresponding to a lowest frequency response dB level in a 3-dB bandwidth range of the frequency response curve; and means for creating a loudness sensitivity curve for a given audio speaker response by subtracting the equal loudness reference curve from the audio speaker response curve.

8. The end user device according to claim 7, further comprising:

a controller for controlling operations of the frequency shifter/processor; and a memory coupled to the controller.

9. The end user device according to claim 7, further comprising:

means for acquiring a listener's threshold audio profile;

means for adding the listener's audio profile to the loudness sensitivity curve for producing the listener's tonal sensitivity curve; and means For normalizing the tonal sensitivity curve for creating a dB curve.

10. The end user device according to claim 9, wherein the means for acquiring the listener's threshold audio profile includes an indication of the listener's hearing acuity in terms of tone thresholds and further indicates the dB gain necessary for the listener for hearing given tones.

11. The end user device according to claim 9, wherein the means for acquiring the listener's threshold audio profile includes:

means for presenting a given configuration routine; and means for receiving the user's selection.

* * * * *